US007080697B2

(12) United States Patent
Mocivnik

(10) Patent No.: US 7,080,697 B2
(45) Date of Patent: Jul. 25, 2006

(54) METHOD AND DEVICE FOR DRILLING A HOLE AND FOR SECURING AN ANCHORAGE IN A BORE HOLE

(75) Inventor: Josef Mocivnik, Fohnsdorf (AT)

(73) Assignee: "ALWAG" Tunnelausbau Gesellschaft m.b.H, Pasching (AT)

( * ) Notice: Subject to any disclaimer, the term of this patent is extended or adjusted under 35 U.S.C. 154(b) by 179 days.

(21) Appl. No.: 10/692,812

(22) Filed: Oct. 27, 2003

(65) Prior Publication Data

US 2004/0084217 A1 May 6, 2004

Related U.S. Application Data

(63) Continuation of application No. PCT/AT02/00120, filed on Apr. 23, 2002.

(30) Foreign Application Priority Data

Apr. 26, 2001 (AT) ..... 327/2001 U
Apr. 5, 2002 (AT) ..... 537/2002

(51) Int. Cl.
*E21B 33/138* (2006.01)

(52) U.S. Cl. ..... 175/22; 175/171; 175/320; 405/259.3

(58) Field of Classification Search ..... 175/171, 175/320, 22; 405/259.3; 411/44
See application file for complete search history.

(56) References Cited

U.S. PATENT DOCUMENTS

| | | | | |
|---|---|---|---|---|
| 4,265,008 | A * | 5/1981 | Lippacher et al. | 29/240 |
| 4,310,266 | A | 1/1982 | Malsbury et al. | 405/259 |
| 4,502,818 | A | 3/1985 | Elders | 405/259 |
| 6,106,200 | A * | 8/2000 | Mocivnik et al. | 405/259.5 |
| 6,397,957 | B1 * | 6/2002 | Mocivnik et al. | 175/320 |
| 2002/0081160 | A1 * | 6/2002 | Mocivnik et al. | 405/259.4 |

FOREIGN PATENT DOCUMENTS

| | | |
|---|---|---|
| DE | 2105888 | 8/1971 |
| EP | 0241451 A1 | 10/1987 |
| EP | 0875663 A1 | 11/1998 |
| WO | WO98/21439 | 5/1998 |
| WO | WO98/58132 | 12/1998 |

* cited by examiner

*Primary Examiner*—William Neuder
(74) *Attorney, Agent, or Firm*—Jacobson Holman PLLC

(57) ABSTRACT

A method and a device for the drilling, in particular the percussive or percussive rotary drilling of a hole in earth or rock and for securing an anchorage in the hole. A bore hole is created by a drill bit mounted on a drill pipe and a sliding sleeve that surrounds the drill pipe at a distance is simultaneously introduced. A sliding sleeve configured with a longitudinal slit is introduced at least partially and rests substantially against the bore hole during the drilling, whereby a reliable anchorage can be achieved with a simple construction by the sliding sleeve with a longitudinal slit.

17 Claims, 5 Drawing Sheets

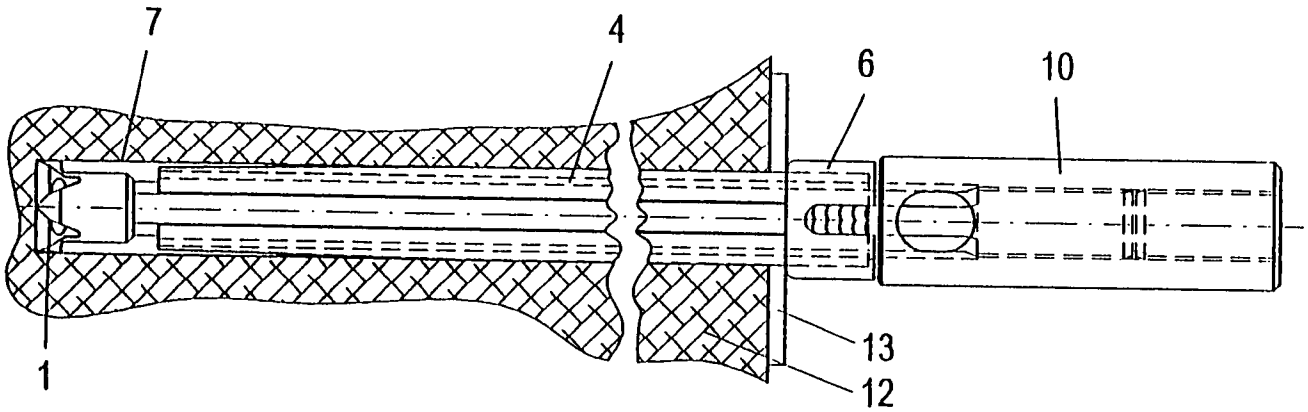
FIG. 5
FIG. 5a
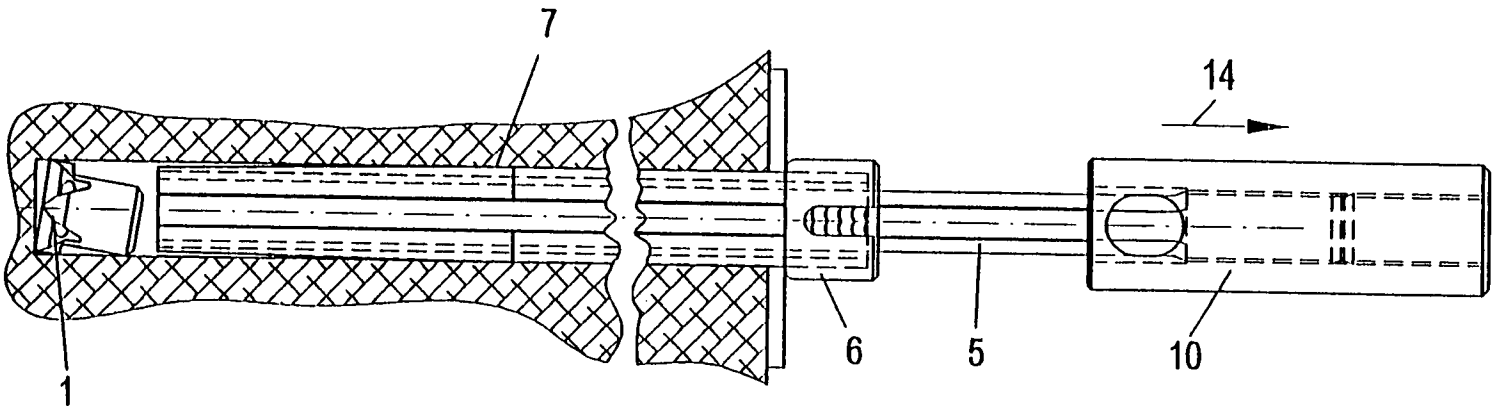
FIG. 5b

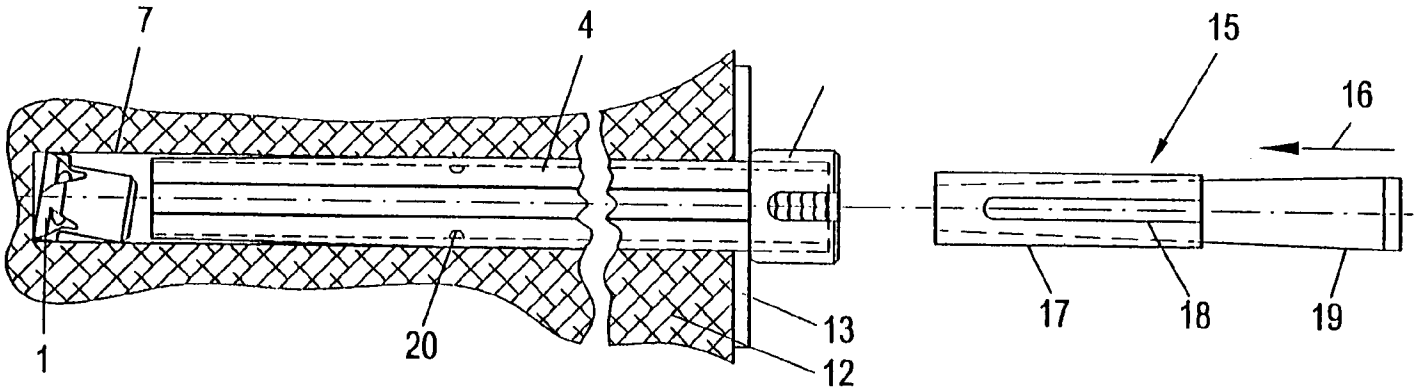
FIG. 5c
FIG. 5
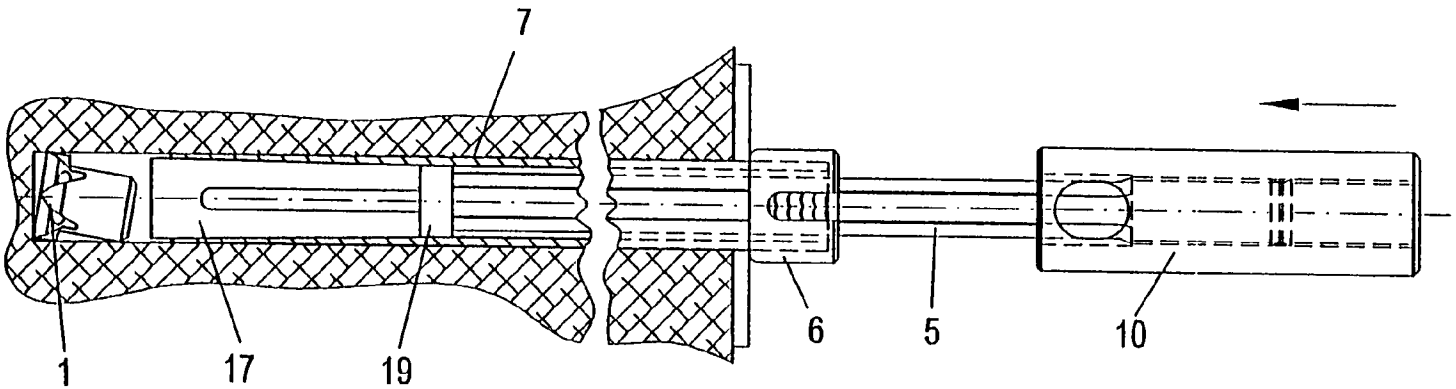
FIG. 5d

METHOD AND DEVICE FOR DRILLING A HOLE AND FOR SECURING AN ANCHORAGE IN A BORE HOLE

This is a continuation application of PCT/AT02/00120, filed on Apr. 23, 2002.

BACKGROUND OF THE INVENTION

The present invention relates to a method for drilling, in particular impact drilling or rotary percussion drilling, a hole in soil or rock material and fixing an anchorage in said hole, wherein a drill hole is formed by means of a drill bit mounted on a drill rod assembly while simultaneously introducing a jacket tube surrounding the drill rod assembly in a spaced-apart manner, as well as a device for drilling, in particular impact drilling or rotary percussion drilling, holes in soil or rock material and producing an anchorage, wherein a drill bit mounted on a drill rod assembly makes a drill hole and a jacket tube surrounding the drill rod assembly in a spaced-apart manner and following the drill bit is provided.

In the context of producing a hole or drill hole in soil or rock material and the subsequent fixation of an anchorage or lining in the drill hole it is known, for instance, from WO 98/21439 and WO 98/58132 to introduce a jacket tube into the drill hole during the drilling procedure, for instance impact drilling or rotary percussion drilling, whereupon, after completion of the drilling procedure, part of the drill bit is optionally removed from the drill hole together with the drill rod assembly, while the jacket tube remains within the drill hole such that an anchor will subsequently be formed within the drill hole by filling a curing mass into the same. According to the configuration set out in WO 98/58132, the drill rod assembly may be provided with additional ribs and grooves on its outer periphery so as to ensure an accordingly good anchoring effect in case the drill rod assembly remains within the drill hole and is subsequently filled.

Alternatively, it is known to remove from the drill hole the drilling tool together with the drill rod assembly after the production of a drill hole, whereupon an anchor or anchoring means is introduced into the drill hole, wherein, for instance, from EP-B 0 241 451, U.S. Pat. No. 4,490,074, DE-AS 21 05 888, U.S. Pat. No. 4,310,266, EP-A 0 875 663 and other documents, configurations are known in which the tubular anchoring means to be introduced subsequently is kept by suitable retention elements at a diameter reduced relative to the final state, whereupon, after the complete introduction of the prestressed tube into the drill hole and removal of the retention means, the tube, which usually comprises a substantially longitudinally extending slot, expands, thus coming into abutment, or being pressed, on the drill hole wall in order to provide the required anchoring effect. That known prior art involves the drawback that, on the one hand, the drill hole has to be made in a first method step, whereupon, after the removal of the drilling tool plus drill rod assembly, the anchoring means is introduced into the optionally very long drill hole in a further method step, after which abutment on the drill hole wall is enabled by the removal of the respective retention means under widening of the outer diameter. It is immediately apparent that the two separate operating steps not only require accordingly more time, but that optionally the subsequent introduction of an anchoring means having a great length involves difficulties. Furthermore, it is to be anticipated that the removal of the drilling device together with the drill rod assembly and the subsequent introduction of an anchoring means is feasible only in comparatively firm soil or rock, where it must be safeguarded that no material will break into the drill hole, for instance, during the drilling procedure or after the removal of the drilling tool and prior to the final introduction of the anchoring means such that the drill hole will not be blocked, thus impeding the introduction of the anchoring means.

SUMMARY OF THE INVENTION

The present invention, therefore, aims to provide a method and a device of the initially defined kind, by which, with a simplified construction, an at least provisional securing is feasible during the drilling procedure and an anchorage to the inner wall of the drill hole can be obtained immediately upon completion of a drill hole.

To solve this object, the method according to the invention, departing from a method of the initially defined kind, is essentially characterized in that the jacket tube, which is formed with a longitudinal slot, is at least partially introduced in substantial abutment on the drill hole during drilling. Since the jacket tube, which is formed with a longitudinal slot, abuts at least partially on the wall of the drill hole during the production of the bore, at least provisional securing during the drilling procedure is feasible, whereby it is safeguarded by the provision of the longitudinal slot that the jacket tube is sufficiently elastic and resilient and, therefore, does not offer too much resistance against the introduction of the jacket tube by the aid of, for instance, a tensile or impact stress, even with an at least partial abutment on the wall of the drill hole. Moreover, the longitudinally slotted jacket tube ensures that an appropriate anchorage by the at least partial abutment on the wall of the drill hole will be obtained immediately upon completion of the bore such that time will be saved in the formation of such an anchorage as compared to known configurations in which the drill rod assembly was removed upon completion of a bore and a separate anchor was introduced into the drill hole. In addition, the method according to the invention can be applied irrespectively of the soil or rock material to be drilled, since the jacket tube is introduced directly during the production or formation of the drill hole, so that even with loose rock, where caving in would optionally have to be feared at least after the removal of the drilling tool and prior to the introduction of the anchorage, no difficulties as might occur with an anchorage to be provided subsequently will have to be feared, because the jacket tube introduced during drilling will itself always keep clear the passage cross section of the drill hole in loose rock. After the drill hole is completed, the drilling tool may either be removed at least partially with the drill rod assembly through the interior of the jacket tube remaining within the drill hole or may be left within the drill hole together with the drill rod assembly plus drilling tool to increase the anchoring effect, so that an anchoring effect not only will result from the abutment of the jacket tube on the inner wall of the drill hole, but the anchoring effect will be enhanced by the drilling tool and drill rod assembly remaining within the drill hole. When introducing the jacket tube, which is provided with a longitudinal slot, at least partially in abutment on the wall of the drill hole, it is to be anticipated further that, by the introduction of a scouring fluid into the region of the drill bit as known per se and the thus effected discharging of excavated material also in the region of the outer periphery of the jacket tube, an accordingly liquid or viscous material layer will be present, which will cause a lubricating or sliding effect during the introduction of the jacket tube. After the completion of the bore, and hence interruption of the continued supply of scouring fluid, it is to be anticipated that the friction between the outer periphery of the jacket tube and the inner wall of the drill hole will accordingly increase upon solidification of the material in the region of the outer periphery of the jacket tube such that an accordingly good anchoring effect of the jacket tube abutting on the inner wall of the drill hole will be obtained.

In order to support the anchoring effect of the jacket tube abutting at least partially on the inner wall of the drill hole already during its introduction, it is proposed according to a preferred embodiment that an expandable element is introduced into the interior of the jacket tube and expanded upon completion of the drill hole and removal of the drill rod assembly. Such an introduction of an expandable element optionally enables the jacket tube to be reliably fixed on the inner wall of the drill hole over partial regions, thus providing an enhanced anchoring effect.

In a particularly simple manner, an expandable element can be fixed in the interior of the jacket tube in that the expandable element is expanded by an impact stress as in correspondence with a further preferred embodiment of the method according to the invention. Such an expandable element not only ensures the reliable abutment of the jacket tube on the inner wall of the drill hole, but also acts against any reduction of the clear cross section of the jacket tube caused, for instance, by a compressive stress exerted by surrounding material or a tensile stress exerted in the longitudinal direction of the anchor formed by the jacket tube, since, by providing the longitudinal slot, tensile stresses acting in the longitudinal direction of the jacket tube that constitutes the anchorage, in particular, might otherwise result in a reduction of the anchor cross section of the jacket tube, whereby the anchoring effect would be accordingly reduced.

Depending on the surrounding material and hence on the nature of the jacket tube, it is preferably proposed for the introduction of the jacket tube during the drilling procedure that the jacket tube is introduced into the drill hole by exerting a tensile stress via a connection with the drill bit and/or an impact stress. According to the invention, the jacket tube may thus be coupled, for instance, with the drill bit in a suitable manner and introduced into the drill hole during the drilling procedure merely by means of tensile stress. Particularly in the event of jacket tubes having larger material cross sections and hence elevated strengths, which are employed to provide an accordingly resistant anchorage, the jacket tube, however, may be additionally or alternatively introduced into the drill hole during the drilling procedure by exerting an impact stress so as to avoid excessive forces to be exerted on the drill bit in order to entrain the jacket tube.

In order to ensure proper introduction of the jacket tube during the drilling procedure, it is proposed in this context, according to another preferred embodiment, that at least one connection provided along the substantially longitudinally slotted jacket tube and defined by a predetermined breaking point is separated upon completion of the bore.

Particularly simple separation or breaking of the predetermined breaking point is preferably feasible according to the invention in that the separation or breaking of the predetermined breaking point is effected by a slight retraction of at least the impact shoe and jacket tube mounted thereon, as well as an actuation of the impact shoe. Thus, after the completion of the bore, the separation or breaking of the predetermined breaking point can be obtained under the expansion or spreading of the front end of the jacket tube, by a slight retraction of at least the impact shoe and optionally the annular drill bit mounted thereto, and the subsequent, second actuation of the impact shoe with the jacket tube held fast or mounted in the produced drill hole in an at least partially frictionally engaged manner, by an expansion of the internal diameter of the longitudinally slotted jacket tube by the impact shoe, for instance by providing mating bearing surfaces in the region of the front end of the jacket tube, so that, in the main, proper abutment of the outer diameter of the expanded jacket tube on the finished wall of the drill hole can be ensured.

In order to further increase the anchoring effect, particularly in the event of loose rock or in cooperation with an anchoring plate to be optionally fixed to the end projecting out of the drill hole, it is proposed according to a further preferred embodiment that a curing mass is filled into the interior of the jacket tube in a manner known per se upon completion of the bore. The curing material is able to penetrate into the surrounding material, in particular, in the front region as well as along the longitudinal slot of the expandable jacket tube, thus improving the anchorage of the jacket tube. By the penetration of the curing material and subsequent bracing with an anchor plate to be provided on the external end of the jacket tube, the fixation of optionally loosely layered soil or rock material can be obtained in addition.

To solve the objects set in the beginning, a device of the initially defined kind, moreover, is essentially characterized in that the jacket tube comprises a longitudinal slot substantially extending in the longitudinal direction of the jacket tube. By providing a jacket tube formed with a longitudinal slot, it is ensured that the jacket tube can be introduced into the drill hole at an accordingly low friction resistance and at least partially in abutment on the inner wall of the drill hole during the drilling procedure, whereupon an appropriate anchoring effect will be obtained upon completion of the drilling procedure by the immediate, at least partial abutment of the jacket tube on the inner wall of the drill hole.

In order to support the anchoring effect, it is proposed according to a preferred embodiment that an expandable element is introducible into the interior of the jacket tube and expandable in abutment on the inner wall of the jacket tube upon completion of the drill hole and removal of the drill rod assembly. Such an expandable element, which is expandable into abutment on the inner wall of the jacket tube, ensures the safe anchorage of the jacket tube within the drill hole, whereby such an expandable element will counteract, for instance, a cross-sectional reduction of the jacket tube, in particular in the event of a tensile stress exerted on the anchorage formed by the jacket tube, thus reliably maintaining the desired anchoring effect.

In order to provide a particularly favorable fixation of the expandable element in the interior of the jacket tube, it is proposed according to a particularly preferred embodiment that the expandable element is comprised of a sleeve which is expandable by an impact stress caused by the introduction of an especially conical element, wherein, in particular, if a plurality of expandable elements is provided in the interior of the jacket tube and in order to ensure proper positioning of the same, it is proposed according to another preferred embodiment that the jacket tube on its inner wall is provided with elevations or projections aimed to position the expandable element.

In order to enable a particularly simple introduction, it is preferably proposed that the jacket tube comprises at least one predetermined breaking point along its longitudinal slot extending substantially in the longitudinal direction of the jacket tube. Due to the at least one predetermined breaking point provided according to the invention along the longitudinal slot of the jacket tube, the jacket tube can be readily introduced into the drill hole during the drilling procedure, while the at least one predetermined breaking point is separated or broken upon completion of the drill hole in order to place the jacket tube in abutment on the inner wall of the drill hole so as to obtain the anchorage.

After the bore is completed, the at least one predetermined breaking point must be separable by the introduction of an appropriate force. On the other hand, the predetermined breaking point must, however, ensure sufficient strength during the drilling procedure, of the longitudinal slot extending substantially over the total length of the jacket tube. To this end, it is proposed according to another preferred embodiment that the at least one predetermined breaking point provided along the longitudinal slot of the jacket tube is formed by a weld bridging the longitudinal slot. By an appropriate positioning and configuration as well as optionally number of welds forming predetermined breaking points, different demands relating both to the resistance during the drilling procedure and the breaking or separation of the predetermined breaking point upon completion of the bore can be met.

For the proper introduction of the jacket tube during the drilling procedure, it is moreover proposed that the jacket tube, on its end facing the drill bit, is fixed to an impact shoe of the drill bit as in correspondence with a further preferred embodiment of the device according to the invention. In addition to introducing the jacket tube by exerting an impact stress by fixing the jacket tube to the drill bit or impact shoe, respectively, it may additionally be provided that an impact stress is exerted on the jacket tube end that projects out of the drill hole, which is feasible, in particular, with jacket tubes having elevated strengths.

In order to obtain a suitable anchoring effect of the jacket tube which is expandable upon completion of the bore, it is proposed according to a further preferred embodiment that the jacket tube is made of a prestressed material, in particular metal.

In order to complete the anchor, or increase the anchoring effect, in particular with partially loose layers of rock material, it is, moreover, preferably proposed according to the invention that upon completion of the drill hole an anchoring plate is fixable to the jacket tube on its end projecting out of the soil or rock material.

In order to ensure the proper haulage of the excavated rocks, it is, moreover, proposed according to a further preferred embodiment that the jacket tube, in the region of its end following the drill bit, in a manner known per se comprises at least one passage opening aimed to introduce the excavated soil or rock material into the interior of the jacket tube such that the excavated material can be discharged from the bore also in the free space, in particular annular space, defined between the drill rod assembly and the jacket tube.

BRIEF DESCRIPTION OF THE DRAWINGS

In the following, the invention will be explained in more detail by way of exemplary embodiments schematically illustrated in the accompanying drawing. Therein:

FIG. 5 shows different steps during the realization of the method according to the invention using a device according to the invention, FIG. 5*a* illustrating the procedure of making a drill hole by the method according to the invention in an illustration similar to that of FIG. 1, FIG. 5*a* showing the removal of the drill rod assembly upon completion of the drill hole, FIG. 5*c* showing the introduction of an expandable element into the interior of the jacket tube upon completion of the drill hole and the removal of the drill rod assembly, and FIG. 5*d* showing the procedure of expanding the expandable element.

DETAILED DESCRIPTION OF THE PREFERRED EMBODIMENTS

Figure 1:
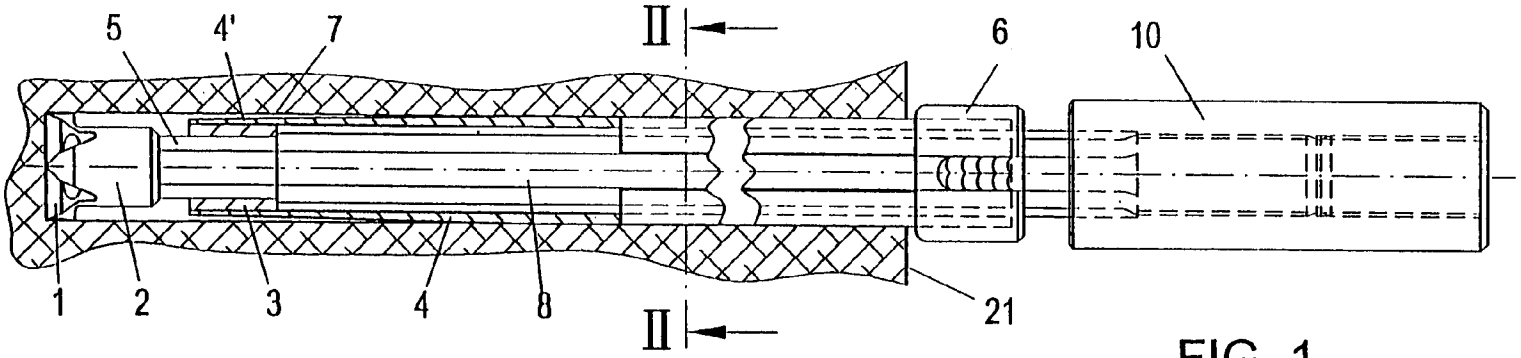
FIG. 1 is a partially sectioned, schematic side view of a first embodiment of a device according to the invention for carrying out the method according to the invention.

In FIG. 1 a drilling tool or drill bit generally denoted by 1 is connected through a connecting piece 2 as well as an impact shoe schematically indicated by 3 with a drill rod assembly 5 extending in the interior of a jacket tube 4. The drill bit 1 is actuated by an impact drilling or rotary percussion drilling device not illustrated in detail and arranged outside the soil or rock material to be worked, whose surface is denoted by 6, via the drill rod assembly 5. The inner contour of a drill hole made by the drilling tool or drill bit 1 is schematically indicated by 7 in FIG. 1.

Figure 2:
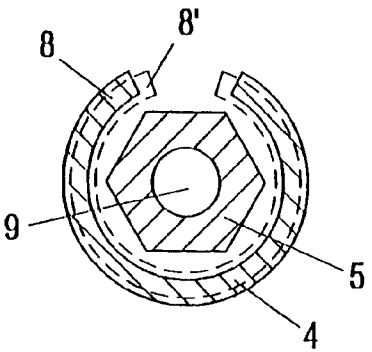
FIG. 2 is a schematic section turned along line II—II of FIG. 1 in an enlarged illustration.

As is apparent from FIG. 1, the jacket tube 4 comprises a longitudinal slot 8 extending substantially in the longitudinal direction, as is also clearly apparent from the illustration according to FIG. 2. From the illustration according to FIG. 2, it is, furthermore, apparent that the sleeve 4 is made of a prestressed material, in particular metal, wherein said material in its relieved state outside the drill hole, which is shown in full lines, has a larger outer diameter than in its state within the drill hole, which is illustrated by thin, broken lines, the slot being denoted by 8'. The jacket tube 4 is, thus, introduced into the drill hole in a prestressed condition so as to ensure that the jacket tube 4 will at least partially abut on the drill hole inner wall 7 in order to thereby enable at least provisional securing already during the drilling procedure.

From FIG. 2 it is, furthermore, apparent that the drill rod assembly 5 is provided with a central passage channel 9, via which a scouring fluid is introduced into the region of the drill bit 1 in order to discharge excavated material at least partially in the region of the outer periphery of the jacket tube 4 between the jacket tube 4 and the drill hole inner wall 7, wherein a lubricating or sliding effect will be obtained by the introduction of the scouring fluid at the interface between the outer periphery of the jacket tube and the drill hole inner wall 7. This lubricating or sliding effect accordingly reduces the friction resistance between the outer periphery of the jacket tube 4 and the drill hole inner wall 7 during the drilling procedure, while a frictionally engaged connection between the jacket tube 4 and the drill hole inner wall 7 can be obtained by curing upon completion of the drill hole 7 and hence interruption of the scouring agent feed into the region of the drill bit 1.

In the embodiment represented in FIG. 1, the introduction of the jacket tube 4, which has a conically tapering outer shape in the region 4' following the drill bit 1, is effected by a tensile stress exerted on the jacket tube 4 via the impact shoe 3.

In FIG. 1, 10 serves to denote a transition sleeve which enables the fixation of an actuating means for impact drilling or rotary percussion drilling, which is not illustrated in detail.

Figure 3:
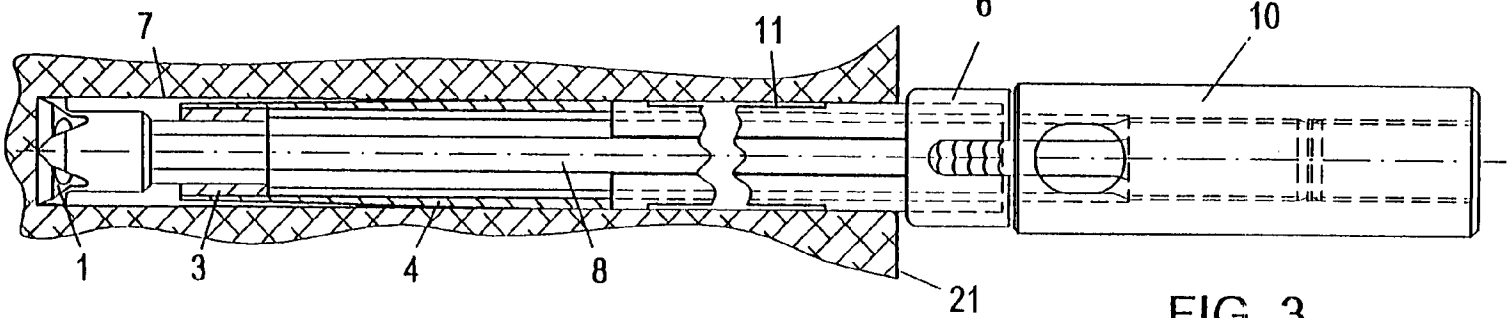
FIG. 3 is an illustration similar to that of FIG. 1, of a modified embodiment of a device according to the invention for carrying out the method according to the invention.

In the modified embodiment depicted in FIG. 3, the jacket tube 4, in addition to the tensile stress applied by the impact shoe 3, is subjected to an impact stress in the region of the anchor head 6 via the transition sleeve 10 such that the jacket tube 4 is introduced into the interior of the drill hole again denoted by 7, both under a tensile stress and under an impact stress.

The jacket tube 4 again comprises a longitudinal slot 8 and is offset, or designed to have a reduced cross section, in partial regions of its outer periphery, such offset partial regions being denoted by 11 in FIG. 3. Thus, only a partial abutment of the jacket tube 4 will be obtained, particularly during the introduction procedure, this being favorable to ensure a proper drilling progress, for instance in the event of a high friction resistance to be expected between the outer periphery of the jacket tube 4 and the drill hole inner wall 7.

Figure 4:
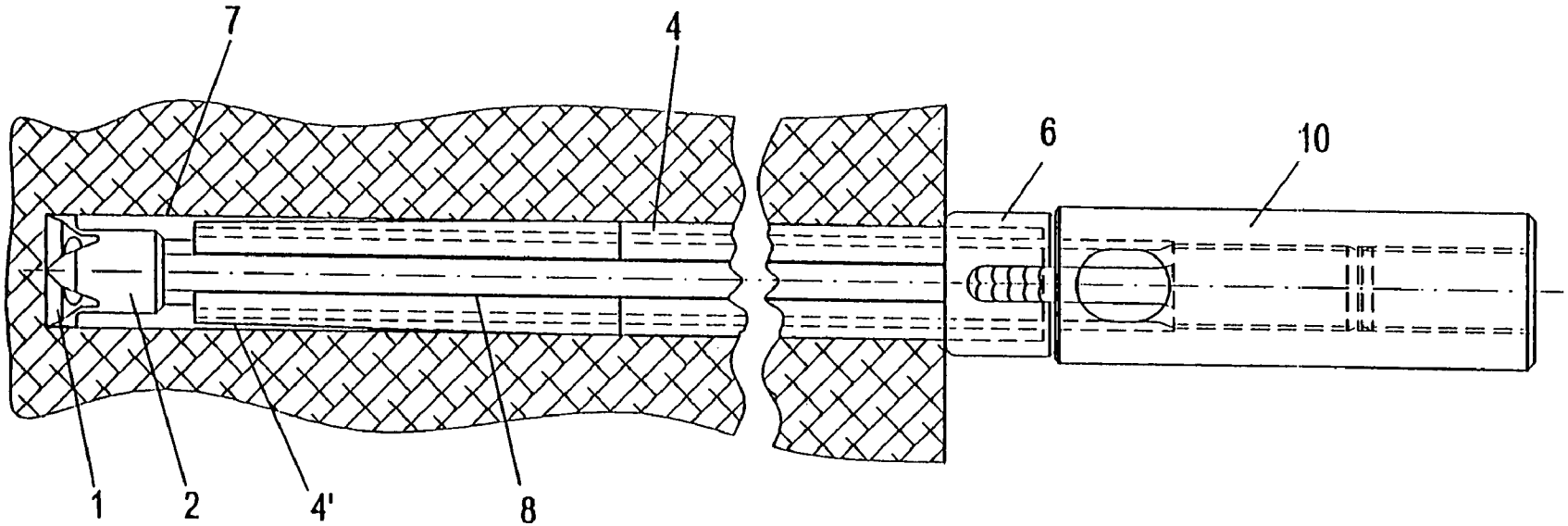
FIG. 4 is another illustration similar to that of FIG. 1, of a further modified embodiment of a device according to the invention for carrying out the method according to the invention.

From the further modified embodiment according to FIG. 4, it is apparent that the jacket tube 4 is introduced into the interior of the drill hole 7 merely by exerting an impact stress on the anchor head 6 by the aid of the transition sleeve 10, while no tensile entrainment through a connection of the jacket tube 4 with the drill bit 1 is effected in this embodiment. Such an introduction of a jacket tube 4 by means of impact stress is feasible, in particular, in the event of an accordingly sturdier jacket tube or a jacket tube 4 exhibiting an elevated strength.

From the individual method steps illustrated in FIG. 5, FIG. 5*a* shows the formation or production of the drill hole 7 while introducing the jacket tube 4 in a manner, for instance, similar to that of the embodiment of FIG. 4 by exerting an impact stress on the anchor head 6, without any connection being provided between the jacket tube 4 and the drill head 1.

In FIG. 5, an anchor plate 13 is each indicated in the region of the end projecting out of the soil or rock material 12.

After the completion of the drill hole 7 as illustrated in FIG. 5*b* the drill rod assembly 5 is removed from the drill hole 7 in the sense of arrow 14, while the drill bit 1 remains within the drill hole 7.

After the removal of the drill rod assembly, an expandable element generally denoted by 15 is introduced into the interior of the jacket tube 4 in the sense of arrow 16. The expandable element 15 is comprised of a conically tapering sleeve 17 at least partially provided with a longitudinal slot 18, whereby a conical element 19 can be introduced into the interior of the sleeve 17.

After the introduction or insertion of the expandable two-part element 15 into the interior of the jacket tube 4, for instance into the region of stops or projections 20 intended to position the expandable element, the conical element 19 is subjected to an impact stress via the transition sleeve 10 so as to cause the two-part expandable element 15 to be positioned on the desired site in the interior of the jacket tube and fixed to the inner wall of the jacket tube 4.

This expandable element 15 upon introduction safeguards that no cross sectional reduction of the jacket tube 4 will occur, for instance, due to a compressive stress exerted by surrounding material or by applying a tensile stress in the sense of an extraction or separation movement of the anchorage, so that the desired anchoring effect will be reliably maintained. If a tensile stress is exerted on the anchor formed by the jacket tube 4, a cross sectional reduction is feasible through the longitudinal slot 8 of the jacket tube 4 in the event no expandable element 15 is provided, whereby such a cross sectional reduction would deteriorate the anchoring effect.

Instead of providing positioning projections 20, the expandable element 15 can also be brought into direct abutment on the drill bit 1 remaining within the drill hole 7 as indicated in FIG. 5*d*. Moreover, it may be provided that a plurality of expandable elements 15 is introduced into the interior of the jacket tube 4 in order to obtain an appropriate support of the anchoring effect of the jacket tube 4 at different points. Such multiple expandable elements 15 can be arranged by appropriately designing, and mating with respective positioning projections 20, in particular the conical sleeve 17.

Alternatively or additionally to introducing the expandable elements 15, it may be provided to fill the interior of the jacket tube 4 with a curable mass upon completion of the drill hole 7 and optionally removal of the drill rod assembly 5.

Figure 6:
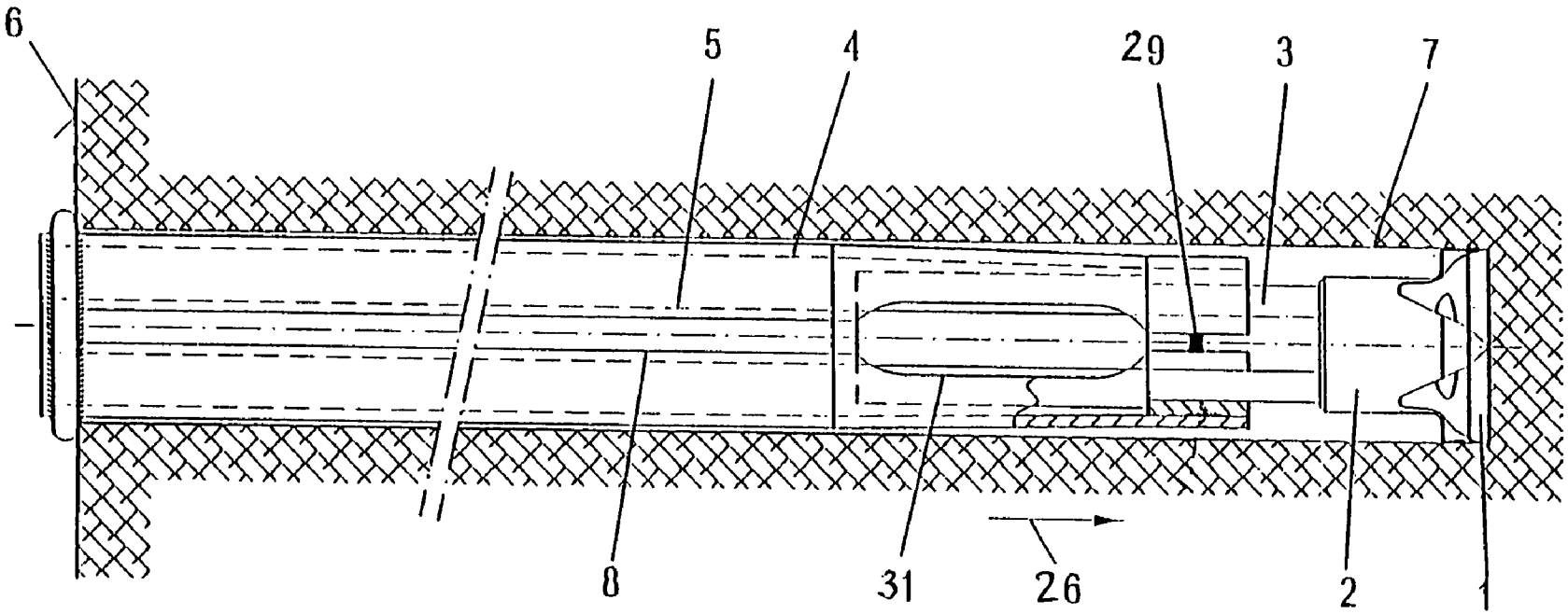
FIG. 6 is a schematic side view of another modified embodiment of a device according to the invention for carrying out the method of the invention.

In FIG. 6, which illustrates a further modified embodiment, 1 serves again to denote a drilling tool or drill bit which is connected through a connecting piece 2 as well as an impact shoe schematically indicated by 3 with a drill rod assembly 5 extending in the interior of a jacket tube 4, wherein the drill bit 1 is actuated by an impact drilling or rotary percussion drilling device not illustrated in detail and arranged outside the soil or rock material to be worked, whose surface is denoted by 6, via the drill rod assembly 5. The inner contour of a drill hole made by the drilling tool or drill bit 1 is again schematically indicated by 7 in FIG. 6.

As is apparent from FIG. 6, the jacket tube 4 again comprises a longitudinal slot 8 extending substantially in the longitudinal direction, wherein at least one predetermined breaking point 29 is provided along the longitudinal extension of the longitudinal slot 8, said predetermined breaking point being formed, e.g., by a weld 29. The jacket tube 4 in this case is fixed on the impact shoe 3 via an intermediate element and is entrained by the impact shoe 3 during the drilling procedure such that the jacket tube 4 formed with the longitudinal slot 8 is introduced into the drill hole 7 directly during the drilling procedure.

To remove the material excavated by the drill bit 1, a passage opening 31 is provided in the front region of the jacket tube 4, said passage opening 31 being formed by forming an enlarged clear passage cross section of the longitudinal slot 8. Through this passage opening 31, material worked off by the drilling tool 1 reaches the free space or annular space defined between the jacket tube 4 and the drill rod assembly 5 and is discharged on the end facing away from the drill bit 1. If necessary, a second passage opening may be provided in the jacket tube 4 on the radially opposite partial region of the periphery, for instance, symmetrical with the passage opening 31.

Upon completion of the bore, the expansion of the prestressed jacket tube 4 is caused by the breaking or separation of the weld defining the predetermined breaking point 29, thus providing the desired anchoring effect.

Upon completion of the bore, the jacket tube 4 and at least the impact shoe 3 as well as drill bit parts mounted thereon, for instance the annular drill bit where a central drill bit and a radially surrounding annular drill bit are provided, are slightly retracted oppositely to the drilling or advancing direction 26, whereupon, after said retraction, the impact shoe 3 is actuated once more via the drill rod assembly 5, again in the direction of the drilling procedure 26, thus separating the predetermined breaking point 29.

What is claimed is:

1. A method for drilling a hole in soil or rock material and fixing an anchorage in said hole, said method comprising forming a drill hole by a drill bit mounted on a drill rod assembly, simultaneously introducing a jacket tube surrounding the drill rod assembly in a spaced-apart manner, the jacket tube being formed with a single longitudinally extending slot, the slot extending along at least a substantial length of the jacket tube, and at least partially introducing the jacket tube in substantial abutment with the drill hole during drilling.

2. The method according to claim 1, wherein the jacket tube is introduced into the drill hole by exerting a tensile stress via at least one of a connection with the drill bit and an impact stress.

3. The method according to claim 1, wherein a curing mass is filled into an interior of the jacket tube upon completion of the bore.

4. A method for drilling a hole in soil or rock material and fixing an anchorage in said hole, said method comprising forming a drill hole by a drill bit mounted on a drill rod assembly while simultaneously introducing a jacket tube surrounding the drill rod assembly in a spaced-apart manner, wherein the jacket tube, which is formed with a longitudinal slot, is at least partially introduced in substantial abutment with the drill hole during drilling, introducing an expandable element into an interior of the jacket tube, and expanding the expandable element, upon completion of the drill hole and removal of the drill rod assembly.

5. The method according to claim 4, wherein the expandable element is expanded by exerting an impact stress.

6. A method for drilling a hole in soil or rock material and fixing an anchorage in said hole, said method comprising forming a drill hole by a drill bit mounted on a drill rod assembly while simultaneously introducing a jacket tube surrounding the drill rod assembly in a spaced-apart manner, wherein the jacket tube, which is formed with a longitudinal slot, is at least partially introduced in substantial abutment with the drill hole during drilling, providing at least one connection along the substantially longitudinally slotted jacket tube and defined by a predetermined breaking point separated upon completion of the bore.

7. The method according to claim 6, wherein the separation of the predetermined breaking point is effected by a slight retraction of at least an impact shoe and jacket tube mounted thereon as well as an actuation of the impact shoe.

8. A device for drilling holes in soil or rock material and producing an anchorage, said device comprising a drill bit mounted on a drill rod assembly for making a drill hole, and a jacket tube surrounding the drill rod assembly in a spaced-apart manner and following the drill bit, the jacket tube including a single longitudinally extending slot extending along at least a substantial length of the jacket tube in a longitudinal direction of the jacket tube.

9. The device according to claim 8, wherein the jacket tube, on an end facing the drill bit, is fixed to an impact shoe of the drill bit.

10. The device according to claim 8, wherein the jacket tube is made of a prestressed metal to allow compressing of the jacket tube along the longitudinally extending slot.

11. A device for drilling holes in soil or rock material and producing an anchorage, said device comprising a drill bit mounted on a drill rod assembly for making a drill hole, and a jacket tube surrounding the drill rod assembly in a spaced-apart manner and following the drill bit, wherein the jacket tube a longitudinal slot substantially extending in a longitudinal direction of the jacket tube, an expandable element introducible into an interior of the jacket tube and expandable in abutment on an inner wall of the jacket tube upon completion of the drill hole and removal of the drill rod assembly.

12. The device according to claim 11, wherein the expandable element is comprised of a sleeve which is expandable by an impact stress caused by the introduction of an especially conical element.

13. A device for drilling holes in soil or rock material and producing an anchorage, said device comprising a drill bit mounted on a drill rod assembly for making a drill hole, and a jacket tube surrounding the drill rod assembly in a spaced-apart manner and following the drill bit, wherein the jacket tube comprises a longitudinal slot substantially extending in a longitudinal direction of the jacket tube, the jacket tube on its inner wall being provided with elevations or projections aimed to position the expandable element.

14. A device for drilling holes in soil or rock material and producing an anchorage, said device comprising a drill bit mounted on a drill rod assembly for making a drill hole, and a jacket tube surrounding the drill rod assembly in a spaced-apart manner and following the drill bit, wherein the jacket tube comprises a longitudinal slot substantially extending in a longitudinal direction of the jacket tube, the jacket tube comprises at least one predetermined breaking point along the longitudinal slot extending substantially in the longitudinal direction of the jacket tube.

15. The device according to claim 14, wherein the at least one predetermined breaking point provided along the longitudinal slot of the jacket tube is formed by a weld bridging the longitudinal slot.

16. A device for drilling holes in soil or rock material and producing an anchorage, said device comprising a drill bit mounted on a drill rod assembly for making a drill hole, and a jacket tube surrounding the drill rod assembly in a spaced-apart manner and following the drill bit, wherein the jacket tube comprises a longitudinal slot substantially extending in a longitudinal direction of the jacket tube, at least upon completion of the drill hole an anchoring plate being fixable to the jacket tube on an end projecting out of the soil or rock material.

17. A device for drilling holes in soil or rock material and producing an anchorage, said device comprising a drill bit mounted on a drill rod assembly for making a drill hole, and a jacket tube surrounding the drill rod assembly in a spaced-apart manner and following the drill bit, the jacket tube including a longitudinally extending slot extending along at least a substantial length of the jacket tube in a longitudinal direction of the jacket tube, the jacket tube, in a region of an end following the drill bit, comprises at least one passage opening aimed to introduce excavated soil or rock material into an interior of the jacket tube.

* * * * *